US011154920B2

(12) United States Patent
Bucci et al.

(10) Patent No.: US 11,154,920 B2
(45) Date of Patent: Oct. 26, 2021

(54) ROLLING MILL FOR ROLLING CONCAVE, ROD-SHAPED BODIES

(71) Applicant: Danieli & C. Officine Meccaniche S.P.A., Buttrio (IT)

(72) Inventors: Annibale Bucci, Dalmine (IT); Cesare Laviosa, Cogoleto (IT); Angelo D'Alessandro, Paderno Dugnano (IT)

(73) Assignee: DANIELI & C. OFFICINE MECCANICHE S.p.A., Buttrio (IT)

( * ) Notice: Subject to any disclaimer, the term of this patent is extended or adjusted under 35 U.S.C. 154(b) by 133 days.

(21) Appl. No.: 16/485,597

(22) PCT Filed: Mar. 1, 2018

(86) PCT No.: PCT/IB2018/051307

§ 371 (c)(1),
(2) Date: Aug. 13, 2019

(87) PCT Pub. No.: WO2018/158720

PCT Pub. Date: Sep. 7, 2018

(65) Prior Publication Data

US 2020/0009625 A1 Jan. 9, 2020

(30) Foreign Application Priority Data

Mar. 1, 2017 (IT) ..... 102017000023064

(51) Int. Cl.
*B21B 25/02* (2006.01)
*B21B 25/06* (2006.01)
(Continued)

(52) U.S. Cl.
CPC ..... *B21B 25/02* (2013.01); *B21B 25/06* (2013.01); *B21B 17/04* (2013.01); *B21B 37/78* (2013.01);
(Continued)

(58) Field of Classification Search
CPC ..... B21C 1/24; B21B 13/008; B21B 17/02; B21B 17/04; B21B 19/02; B21B 19/04;
(Continued)

(56) References Cited

U.S. PATENT DOCUMENTS 1,758,413 A * 5/1930 Stiefel ..... B21B 25/02 72/97
2,048,925 A * 7/1936 Diescher ..... B21B 19/02 72/96
(Continued)

FOREIGN PATENT DOCUMENTS

CN 104384192 3/2015
EP 153495 A2 * 9/1985 ..... B21C 1/24
(Continued)

*Primary Examiner* — Edward T Tolan
(74) *Attorney, Agent, or Firm* — Stetina Brunda Garred and Brucker

(57) ABSTRACT

A rolling mill for rolling hollow or, in all cases, concave rod-shaped bodies, in particular tubes, in particular seamless tubes, said rolling mill comprising a rolling section (10) with a plurality of mill stands and/or rolling dies (11) arranged in succession to define a rolling axis Y, said rolling mill further comprising moving means for moving a mandrel (20) and a tubular blank (21) fitted onto an end portion (22) of said mandrel (20) along said rolling axis and through said mill stands or rolling dies (11) in succession; wherein said moving means are structured so as to move said mandrel (20) and said blank (21) along said rolling axis Y and through said mill stands or rolling dies (11) in succession by applying a traction on said mandrel.

7 Claims, 10 Drawing Sheets

(51) Int. Cl.
*B21B 17/04* (2006.01)
*B21B 37/78* (2006.01)

(52) U.S. Cl.
CPC ..... *B21B 2261/04* (2013.01); *B21B 2261/08* (2013.01)

(58) Field of Classification Search
CPC ..... B21B 19/06; B21B 25/00; B21B 25/02; B21B 25/06; B21B 39/06; B21B 17/06
See application file for complete search history.

(56) References Cited

U.S. PATENT DOCUMENTS 2,569,104 A * 9/1951 Jaenchen ..... B21B 25/02 72/13.5
3,118,329 A * 1/1964 Hendrickson ..... B21B 25/02 72/209
3,267,718 A * 8/1966 Grube ..... B21B 25/06 72/422
3,654,794 A * 4/1972 Brak ..... B21C 3/12 72/285
4,289,011 A 9/1981 Yoshiwara et al.
4,311,032 A * 1/1982 Nessi ..... B21B 25/02 72/208
4,361,023 A * 11/1982 Blanquet ..... B21B 25/02 72/209
4,724,697 A * 2/1988 Hien ..... B21B 25/02 72/208
5,390,538 A * 2/1995 Spath ..... B21D 9/10 72/133
2007/0271986 A1 * 11/2007 Geser ..... B21J 5/12 72/367.1

FOREIGN PATENT DOCUMENTS

EP 2878390 6/2015
GB 2019281 A * 10/1979 ..... B21B 19/16
JP S58116908 7/1983
JP S61154704 7/1986

* cited by examiner

ROLLING MILL FOR ROLLING CONCAVE, ROD-SHAPED BODIES

CROSS REFERENCE TO RELATED APPLICATION(S)

The present application claims priority to PCT International Application No. PCT/IB2018/051307 filed on Mar. 1, 2018, which application claims priority to Italian Patent Application Nos. 102017000023064 filed Mar. 1, 2017, the entirety of the disclosures of which are expressly incorporated herein by reference.

STATEMENT RE: FEDERALLY SPONSORED RESEARCH/DEVELOPMENT

Not Applicable.

TECHNICAL FIELD OF THE INVENTION

The present invention relates to the technical field of rolling of hollow or, in all cases, concave rod-shaped elements. In particular, the present invention relates to the technical field of rolling of tubes, in particular seamless. In detail, the present invention relates to a rolling mill for rolling tubular elements, in particular seamless tubes. In more detail, the present invention relates to a rolling mill of the aforesaid type for rolling tubular elements, in particular seamless, based on the movement of a blank fitted onto a mandrel through mill stands and/or rolling dies by applying a traction to the mandrel itself.

BACKGROUND ART

Producing seamless tubular elements by rolling a blank fitted onto a mandrel is known in the prior art. In practice, according to the prior art, the tubular elements are obtained from a blank by means of forced passage of said blank, fitted onto a mandrel, through a plurality of mill stands and/or rolling dies arranged in succession along a predetermined direction, where each mill stand or rolling die precisely defines a passage, and where mill stands and/or successive dies (arranged in succession along the advancement direction of the mandrel) define passages of gradually decreasing size, and where by effect of the pressure applied on the blank by the mill stands and/or dies and the mandrel itself, the thickness is reduced and the gradual lengthening of the starting blank is obtained, resulting in the formation of the tube or tubular element.

For example, in the case of rolling mill stands, the use of mill stands is known comprising a plurality of rolls (at least two), e.g. idle but also motorized and of variable number (e.g. three), according to requirements and/or circumstances, mutually arranged so as to define the forced passage referred to above, the size of the passage being defined by the size, shape and mutual arrangement of the rolls in the respective mill stand.

Instead, the blank is obtained from a "billet" according to methods which vary according to requirements and/or circumstances.

According to a first method, a cup-shaped blank is made (i.e. with a cylindrical inner cavity, which is blind at one end) by means of a press, e.g. vertical, by means of which a punch is pushed into the appropriately heated initial billet (or bloom) to form said blind cylindrical cavity.

The rolling of the blank with the (cup-shaped) blind cavity obviously implies the need, at the outlet of the mandrel from the rolling mill stands, to separate the tube now practically formed from the mandrel itself, and also to cut the end (bottom) from parent tube before the tube is sent to (possible) next machining cycles (in particular, to deformation cycles).

Instead, according to the aforesaid second method, the blank is obtained again from an initial billet (or bloom), but in this case by means of a transversal perforation process to form a tubular blank with substantially cylindrical through, and therefore not blind, inner cavity.

The rolling of a non-blind tubular blank naturally offers the advantage of improving the use of starting material (whereby avoiding the waste resulting from cutting the bottom) but requires the blank, once fitted onto the mandrel, to be crimped onto the mandrel in its front-end zone in order to avoid the sliding of said portion of the blank on the mandrel during rolling.

However, regardless of the type of blank used (cup-shaped with a blind cavity or tubular with through cavity), according to the current rolling techniques and/or methods, the blank fitted onto the mandrel is fed through the rolling mill stands and/or dies by the push applied onto the mandrel.

For this purpose, in particular, a push bar is used, which engages, precisely by pushing, the end portion of the mandrel opposite to the one on which the blank is fitted.

There are various disadvantages and/or drawbacks of the rolling techniques according to the prior art based on the movement of the mandrel (with consequent feeding of the blank) by pushing applied onto the mandrel itself.

Firstly, the use of a push bar of length at least slightly greater than that of the mandrel itself is required; for example, for producing tubes with a length of about 21 m-21.5 m, the total length of the mandrel and push bar exceeds 45 m, with evident problems of dimensions. Furthermore, the mandrel-push bar assembly, when subject to compression, and thus in particular during the pushing on the mandrel by means of the bar, behaves as a very slender rod, the behavior of which is inherently unstable and therefore requires the provision of substantial containing and/or safety means. For example, it is typical to use a series of containment guides with appropriately shaped sliding rails dimensioned to minimize the movement space both of the mandrel of the push bar during the working stroke. Such guides are also subject to considerable forces, collisions and vibrations during rolling, where the use of the guides requires the provision of fixing systems of the guides themselves, where the length of the guides may exceed 40 m, and where the use of guides implies very high maintenance costs deriving from the need to replace the worn linear rails. Furthermore, additional management costs must be considered arising from the need, in the case of systems which allow the use of mandrels of different diameter, to act on the containment guides and/or replace the linear rails with linear rails of a suitable diameter for every change of the mandrel, this operation being of considerable complexity and duration.

Finally, the tip-loaded push rod system, typical as previously mentioned of push bench rolling mills, involves the inevitable twisting movement of the mandrel between the mill stands and/or rolling dies, which define its containment, with the inevitable result of undesired side loads on the mill stands and/or dies, and thus with the inevitable deterioration of the dimensional tolerances of the tubes, or also with the risk of damaging or decommissioning the mill stands, in the case of excessive pushes or lateral loads.

The mandrel subjected to pushing is also potentially dangerous if it jams by colliding, for example, with the mill stands and/or exits laterally from the containment represented by rolling mill stands themselves.

It is thus the main object of the present invention to overcome or at least minimize the drawbacks summarized above and found in the push rolling mills of the prior art.

In particular, it is a first object of the present invention to provide a solution for rolling tubular elements, in particular seamless, from tubular blanks with through cylindrical inner cavity (hereinafter also simply defined as "perforated"), which allows to overcome or at least minimize the problems summarized above and found in push bench rolling mills according to the prior art.

In particular, it is an object of the present invention to provide a rolling mill of the aforesaid type which is characterized by low installation costs, equally low and/or contained maintenance costs, easy or at least simplified usage and which allows to reduce the risks both for operators and of damage to the mill stands and/or dies, and which is also characterized by improved versatility since it can be used, without substantial changes, such as, for example, the replacement of the sliding rails (if provided) for rolling tubular elements of different diameters using respectively different diameter mandrels.

DESCRIPTION OF THE PRESENT INVENTION

The present invention is based on the general consideration according to which the disadvantages found in rolling mills of the push bench type according to the prior art and briefly summarized above can be overcome by means of a solution which provides for the movement of the mandrel (and, by feeding, of the hollow blank fitted thereon) by means of the traction on the mandrel itself.

In this manner, both the twisting of the push rod-mandrel assembly and the side pushes on the mill stands and/or rolling dies which derive from it are avoided or at least limited.

Finally, by avoiding the use of a push bar, it is possible to contain the depth of the underlying foundations, and to avoid the use of guides and/or of the respective sliding rails which are indispensable in the case of push bench rolling mills.

In consideration of the above concerning the drawbacks encountered on the rolling mills according to the prior art and concerning the purposes of the present invention, according to an embodiment the present invention relates to a rolling mill for rolling tubes, in particular seamless, said rolling mill comprising a rolling section with a plurality of mill stands and/or rolling dies arranged in succession to define a rolling axis, said rolling mill further comprising moving means for moving a mandrel and a tubular blank fitted onto an end portion of said mandrel along said rolling axis and through said mill stands or rolling dies in succession; where said moving means are structured so as to move said mandrel and said blank along said rolling axis and through said mill stands or rolling dies in succession by traction on said mandrel.

According to an embodiment, said moving means comprise an engaging operating head switchable between a first releasing configuration and a second engaging configuration and adapted to engage and alternatively release a shank integral with said end portion of said mandrel, where with said operating head in said second engaging configuration and engaged on said shank, the moving of said engaging operating head along a direction parallel to said rolling axis results in said mandrel and said blank being translated along said rolling direction and through said mill stands or rolling dies in succession.

According to an embodiment, said engaging operating head comprises at least one first rocker arm adapted to be switched to pivot between a first position and a second position, and where the switching of said at least one rocker arm from said first position to said second position results in said operating head being switched from said first releasing configuration to said second engaging configuration, while the switching of said at least one rocker arm from said second position to said first position results in said operating head being switched from said second engaging configuration to said first releasing configuration.

According to an embodiment, said roller mill comprises switching means for switching said at least one rocker arm alternatively between said first and second positions.

According to an embodiment, said at least one first rocker arm is hinged on a point integral with a traction rod of said moving means, where said traction rod is housed at least partially in a tubular jacket which can be translated with respect to said rod, and where the translation of said tubular jacket with respect to said traction rod in a first translation direction results in said at least one first rocker arm being switched from said first position to said second position, while the translation of said tubular jacket with respect to said rod in a second translation direction opposite to the first translation direction results in said at least one rocker arm being switched from said second position to said first position.

According to an embodiment, said rolling mill comprises first translation means for translating said tubular jacket with respect to said traction rod in said first translation direction.

According to an embodiment, first translation means comprise a first fixed switching station, which defines at least one first engagement surface, and at least one second rocker arm, hinged on a point integral with said traction rod, where the translation of said traction rod along a translation direction parallel to said rolling direction and in a first translation direction results in said at least one first engagement surface being engaged by said at least one second rocker arm and said at least one second rocker arm being switched from a first position to a second position, and where the switching of said at least one second rocker arm from said first position to said second position results in said tubular jacket being translated in said second translation direction.

According to an embodiment, said first translation means comprise means for switching said at least one first engagement surface of said first fixed station in releasing position by said at least one second rocker arm, where said first translation means comprise elastic means for automatically translating said tubular jacket in said first translation direction, where said at least one first engagement surface of said first fixed station is released from said at least one second rocker arm.

According to an embodiment, said rolling mill comprises second translation means for translating said tubular jacket with respect to said traction rod in said second translation direction.

According to an embodiment, said second translation means comprise a second fixed switching station, which defines at least one second engagement surface, where the translation of said traction rod along a translation direction parallel to said rolling direction and in a second translation direction opposite to said first translation direction results in the engagement of said at least one second engagement surface by said at least one second rocker arm and in said at least one second rocker arm being switched from said first position to said second position, and where the switching of said at least one second rocker arm from said first position to said second position results in the translation of said tubular jacket in said second translation direction.

According to an embodiment, said second translation means comprise means for switching said at least one second engagement surface of said second fixed station in releasing position by said at least one second rocker arm, where with said at least one second engagement surface of said second fixed station released from said at least one second rocker arm, the action of said elastic means results in the automatic translation of said tubular jacket in said first translation direction.

Further embodiments of the rolling mills according to the present invention are defined in the claims.

The present invention further relates to a rolling method implemented by a rolling mill according to one of the embodiments summarized above.

BRIEF DESCRIPTION OF THE DRAWINGS

Hereafter, the present invention will be further explained by means of the following detailed description of the possible embodiments shown on the drawings, in which corresponding or equivalent features and/or component parts of the present invention are identified by the same reference numbers. It should be noted that the present invention is not limited to the embodiments described below and shown in the accompanying drawings; on the contrary, all the variants and/or changes to the embodiments described below and shown in the accompanying drawings will appear obvious and immediate to those skilled in the art.

In the drawings.

DETAILED DESCRIPTION OF THE PRESEND INVENTION

The present invention is particularly applied in the field of tubular elements, in particular of seamless tubes, these being the reason for which the present invention is described below with particular reference to its applications in the field of tubular element rolling.

However, it is worth specifying that the possible applications of the present invention are not limited to those described below. On the contrary, the present invention is conveniently applied to all cases of rolling of hollow rod-like or, in all cases, concave elements in general.

Figure 1:
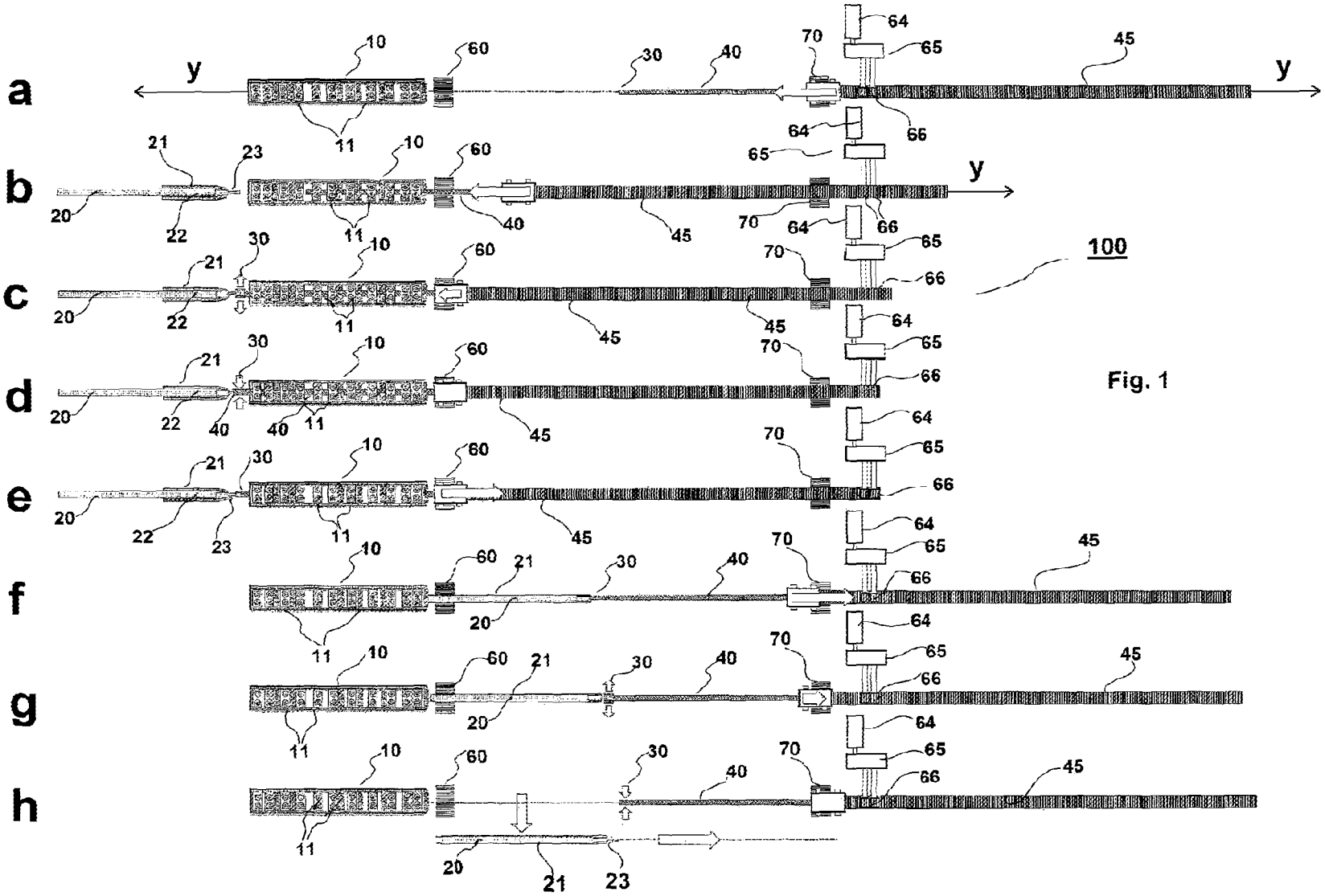
FIG. 1 shows a first diagrammatic plan view of a rolling mill according to an embodiment of the present invention and of the main rolling steps implemented by the said rolling mill.

The rolling mill according to the embodiment of the present invention shown in FIG. 1 is identified by the reference numeral 100 and essentially comprises a rolling mill section (or bench) 10 comprising mill stands and/or rolling dies 11 arranged in succession and each forming a passage. In the scope of the present invention, it is possible to provide mill stands and/or dies 11 of a different type, e.g. idle and/or motorized rolls mill stands; being the mill stands and/or dies of known type, and being the rolling methods also of known, a detailed description is omitted for the sake of brevity. We will only specify that, for reasons of clarity, tubular elements, in particular seamless, are made by means of the rolling mill 100 by passing a tubular blank with through cavity 21 fitted onto the end portion 22 of a mandrel 20 through the mill stands and/or dies 11 in succession, according to substantially known methods and therefore not described in detail. For this purpose, the rolling mill 100 is equipped with moving means which comprise a traction bar 40 fixed to a toothed bar 45 on which one or more pinions 66 engage, which are turned by means of a power source 64 (e.g. an electric motor) by means of a transmission 65. It is therefore apparent that the rotation of one or more pinions 66 engaging the toothed bar 45 alternately in two opposite rotation directions translates into a translation movement of the bar 45 and thus of the traction bar 40 connected thereto, respectively in the two opposite translation directions, i.e. from the right leftwards and from the left rightwards with reference to FIG. 1. The end of the traction bar 40 opposite to the toothed bar 45 is also equipped with a switchable operating header 30 and suited respectively to hook and unhook a shank 23 which is integral with the end portion 22 of the mandrel 20 (FIG. 2), in particular engaged by screwing into a blind cavity threaded of the mandrel 20. The switching method of the operating header 30 will be described below with reference to other figures, in which in all cases, with reference to FIG. 1, the methods and main steps of processing of the rolling mill 100 can be summarized as follows.

The starting situation is the one shown in FIG. 1*a*, i.e. in which the traction bar 40 is in retracted position (all right with reference to the figure) relative to the bench 10 and the header 30 is in the closed configuration; it will be apparent from the following description that the situation in FIG. 1*a* substantially coincides with the final situation at the end of a rolling cycle. During the next step (not shown), the mandrel 20, with the blank 21 fitted thereon as described above, is positioned at the bench 10, on the opposite side with respect to the traction bar 40, where during the next step (FIG. 1*b*) the bar 40 with the header 30 still in the closed configuration, is firstly approached to the bench 10 (by rotating the pinions 66) and progressively introduced into the bench 10, i.e. through the mill stands and/or dies 11 (in the passage defined by each one of them). FIG. 1*c* shows the header 30 at the outlet from the bench 10 where, during this step, the header 30, exiting from the bench 10, is automatically switched from the closed configuration to the open configuration (see also the following description). Then (FIG. 1*d*), the header 30 is further approached to the shank 23, where the protruding portion of the shank 23 is located in the inner space defined by the header 30, precisely in the open configuration. Afterwards, the header 30 is switched, still automatically, from the open configuration to the closed configuration, whereby completing the latching of the shank 23 and thus of the mandrel 20. During the successive step (FIG. 1*e*), the bar 40 is translated in the opposite translation direction (from the left rightwards, with respect to the figure), by rotating the pinions 66 in the respectively opposite rotation direction, thus where then the bar 40, in its translation motion, feeds the mandrel 20 and thus the blank 21 through the mill stands and/or the dies 11 of the rolling bench 10. FIG. 1*f* shows the mandrel 20 and the blank 21 (by now transformed into the final tubular element) immediately before the fully exiting from the bench 10. During the successive step (FIG. 1*g*), with the mandrel 20 and the tubular element completely outside of the bench 10, the header 30 is again switched automatically from the closed configuration to the open configuration, in this way releasing (unhooking) the shank 23 and thus the mandrel 20 with the tubular element fitted thereon. Finally (FIG. 1*h*), the mandrel-tubular element assembly is moved (according to methods substantially known and therefore not described in detail), in particular repositioned in misaligned position with respect to the bar 40, to finally be sent to successive final operations, such as for example the removal of the mandrel 20 and/or the finishing operations of the tubular element. At this point, the rolling cycle has ended and the next cycle can be started, in particular switching the header 30 again from the open configuration to the closed configuration and thus repeating the steps and/or processes shown in figures from 1*a* to 1*h*.

Hereinafter, with reference to figures from 2 to 5, further details of the switchable header 30 and of the respective steps of switching will be provided, where in the figures from 2 to 5, component parts and/or features previously described above with reference to FIG. 1 are identified by means of the same reference numerals.

Figure 2:
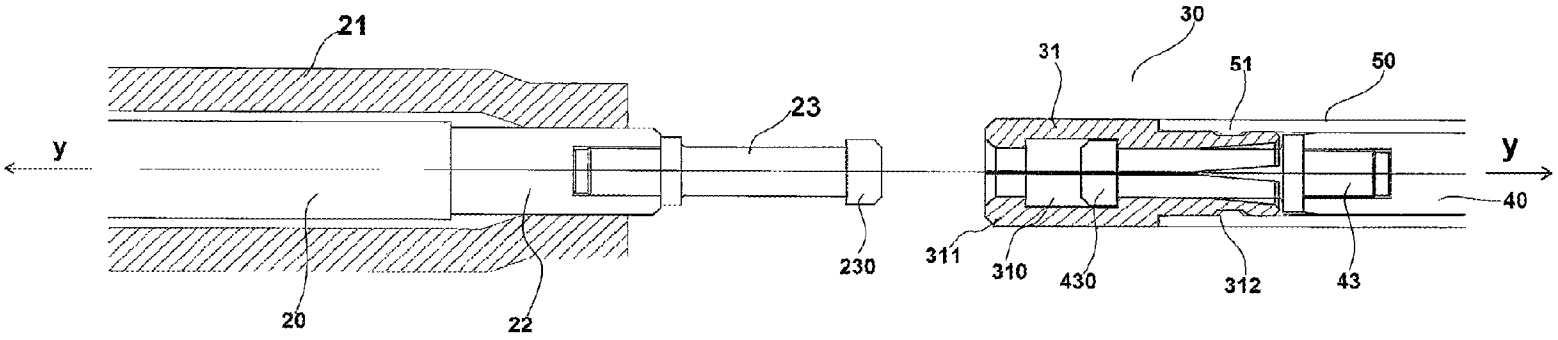
FIG. 2 shows a longitudinal section view of the engaging head (in closed configuration) of the moving means of a rolling mill according to an embodiment of the present invention, said engagement head being shown in the configuration and in the position preceding the engagement by the head of a mandrel.

Indeed, FIG. 2 shows the header 30 (fixed to the end portion of the traction bar 40, the tang 23 integral to the end portion 22 of the mandrel 20, and blank 21 fitted onto the mandrel 20, in particular crimped onto the mandrel 20 to avoid sliding of the blank 21 along the mandrel 20 during the rolling operations described above, and to define a through opening for the shank 23.

Figure 4:
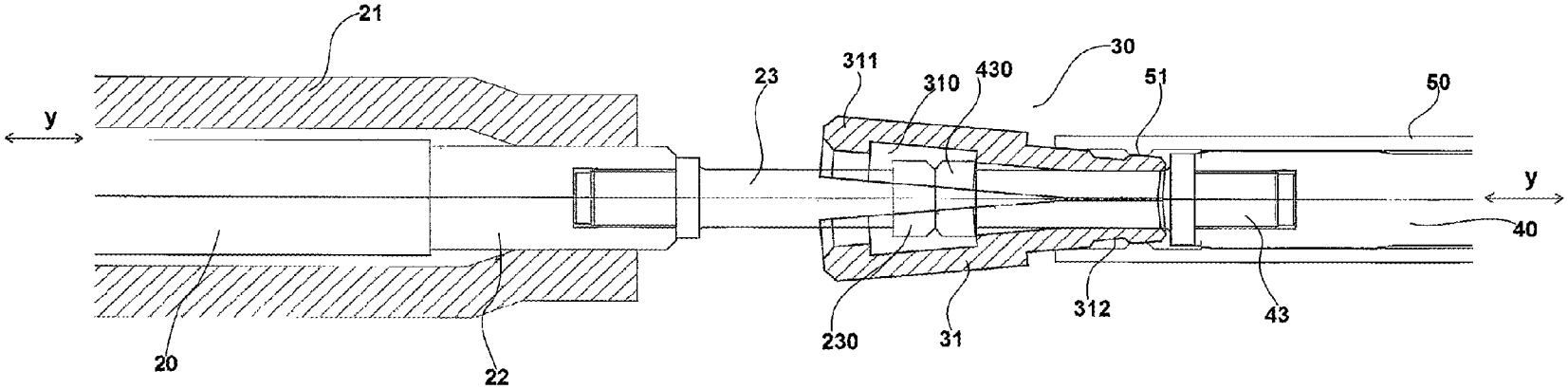
FIG. 4 shows a longitudinal section view of the engaging head (in open configuration) of the moving means of a rolling mill according to an embodiment of the present invention, said engagement head being shown in the configuration and in the position immediately preceding the engagement by the head of a mandrel.
Figure 5:
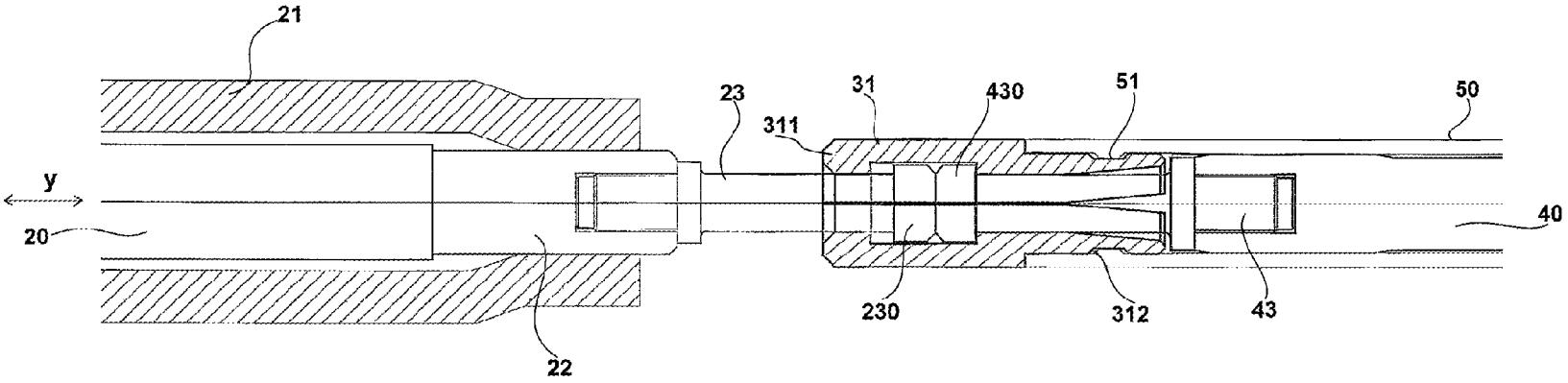
FIG. 5 shows a longitudinal section view of the engaging head (in closed configuration) of the moving means of a rolling mill according to an embodiment of the present invention, said engagement head being shown in the configuration and in the position preceding the engagement by the head of a mandrel.

As shown in the figures, the header 30 comprises a plurality of rocker arms or petals 31 (three in number, in the embodiment shown, even though the number of the petals 31 may vary according to requirements and/or circumstances), each of the petals 31 being hinged on a central carrier bar 43, fixed in turn to the end portion of the traction bar 40, in particular engaged by screwing in a blank threaded housing of the bar 40, according to methods substantially similar to those previously described for fixing of the shank 23 to the end portion 22 of the mandrel 20. In particular, each of the petals 31 can rotate about a rotation axis substantially perpendicular to the longitudinal axis of symmetry of the central carrier bar 43. Furthermore, each of the petals 31 is shaped so as to define an inner recess 310 and comprises a hook-shaped end portion 311, where an end flange 430 fixed to the carrier bar 43 is housed in the inner space defined by the petals 31. In the same way, the shank 23 also comprises an end flange 230, where it can be inferred that by closing the header 30 on the shank 23, the flange 230 is housed in the inner space defined by the petals 31, and thus engaged by the hook-shaped end 311 of each of the petals 31 (FIGS. 4 and 5).

For switching the header 30 between the closed and opened configurations, according to the embodiment form of the present invention shown in the figures, a tubular jacket 50 is provided, inside which the traction bar 40, the carrier bar 43 (partially) and the end portions of the petals 31 opposite to the hook-shaped end portions 311 are housed. The tubular jacket 50 can translate with respect to the traction bar 40 (and thus with respect to the carrier bar 43 and ultimately to the header 30) in the two opposite translation directions (from the right leftwards and from the left rightwards, with respect to figures and according to methods described in detail below), where the end portion of the jacket 50 in which the partially housed petals 31 has an inner annular protrusion 51 adapted to engage, during the translation of the jacket 50, with corresponding outer recesses 312 of the petals 31, each petal 31 thus presenting a corresponding outer recess 312.

Figure 3:
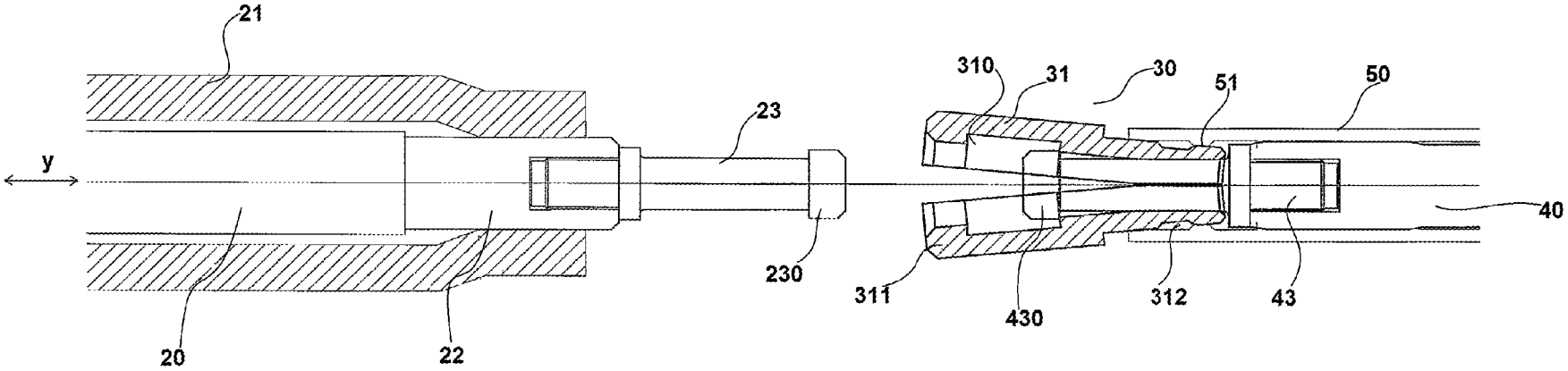
FIG. 3 shows a longitudinal section view of the engaging head (in open configuration) of the moving means of a rolling mill according to an embodiment of the present invention, said engagement head being shown in the configuration and in the position preceding the engagement by the head of a mandrel.

It can inferred from the above that, from the open configuration of the header 30 (FIG. 4), the translation of the jacket 50 toward the header 30 (from the right leftwards in FIG. 4), by virtue of the engagement of the annular protrusion 51 with the recesses 312 results in the switching of the header 30 (of the petals 31) in the closed configuration (FIG. 5) and then in the engagement of the petals 31 on the shank 23, where on the contrary the translation of the jacket 50 away from the header 30 (from the left rightwards) results in switching of the petals 31 from the closed configuration (FIG. 2) to the open configuration (FIG. 3).

Hereafter, with reference to the figures from 6 to 8, the solution will be described according to an embodiment of the present invention for translating the tubular jacket 50 with respect to the traction bar 40, and thus ultimately for switching the header 30 between its open and closed configurations. In figures from 6 to 8, reference numeral 60 identifies a switching station comprising a hollow main body 610 inside which the traction bar 40 and the jacket 50 can slide in the translation according to the methods described above. As shown, the fixed station 60 is positioned in the immediate vicinity of the bench 10 and is provided for switching the header from the closed configuration to the open configuration and from the open configuration to the closed configuration during the steps of the rolling process described above and diagrammatically shown in FIGS. 1*c* and 1*d*. In the situation shown in FIG. 6, the header 30 is then positioned immediately outside the bench 10, on the opposite side with respect to the station 60 (FIG. 1*c*), but still in the closed configuration. One or more contrast elements 611 are positioned inside the main body 610, each defining a contrast surface or engagement 61. Still as shown, the contrast elements 611 can be switched by means of a linkage system 62 (which can be activated, for example, by hydraulic pistons or the like) between two end positions, in particular between a first end position (closed, FIG. 6) in which they are completely housed in the inner space defined by the hollow body 610 to restrict said inner space, and a second position of open end (FIG. 8), in which the opposing elements 611 are retracted toward the outside of the hollow body 610 with respect to the position in FIGS. 6 and 7. In the open position in FIG. 8, the elements 611 are then placed at a distance greater than the mutual distance at which they are arranged in the closed configuration in FIGS. 6 and 7.

Figure 6:
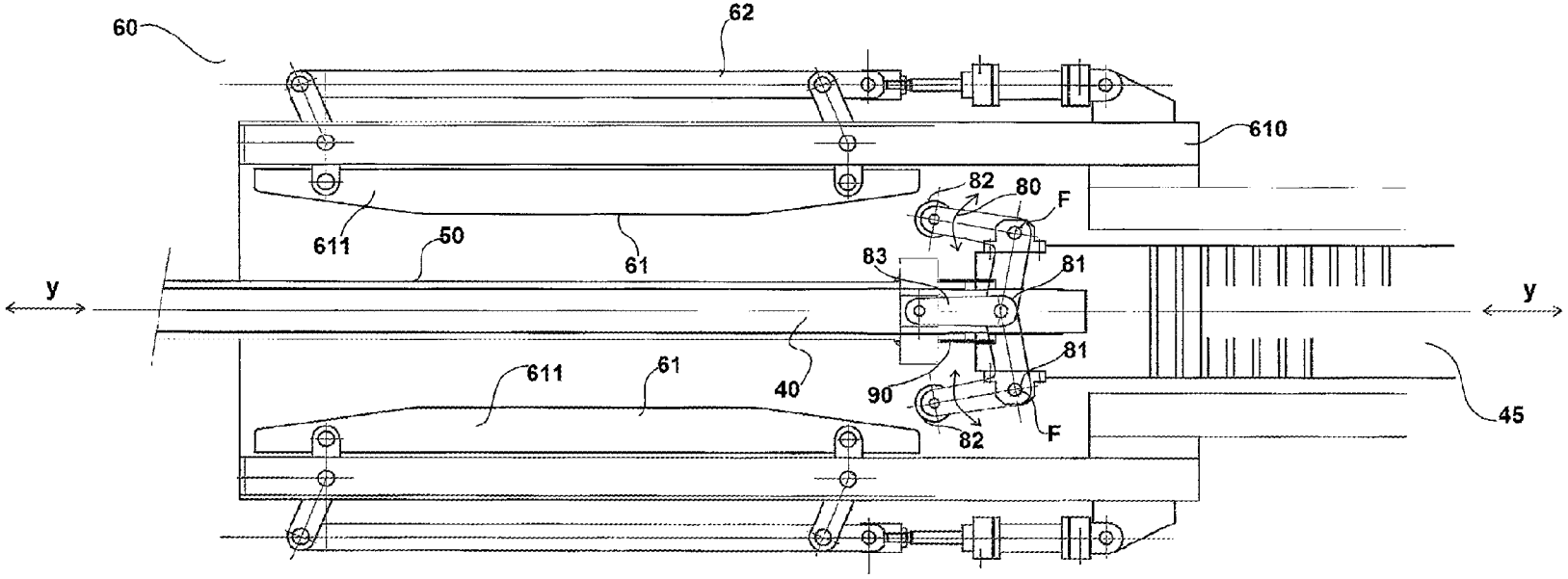
FIG. 6 shows a longitudinal section view of the rolling mill unit according to an embodiment of the present invention for switching the engagement head during a step of switching.
Figure 7:
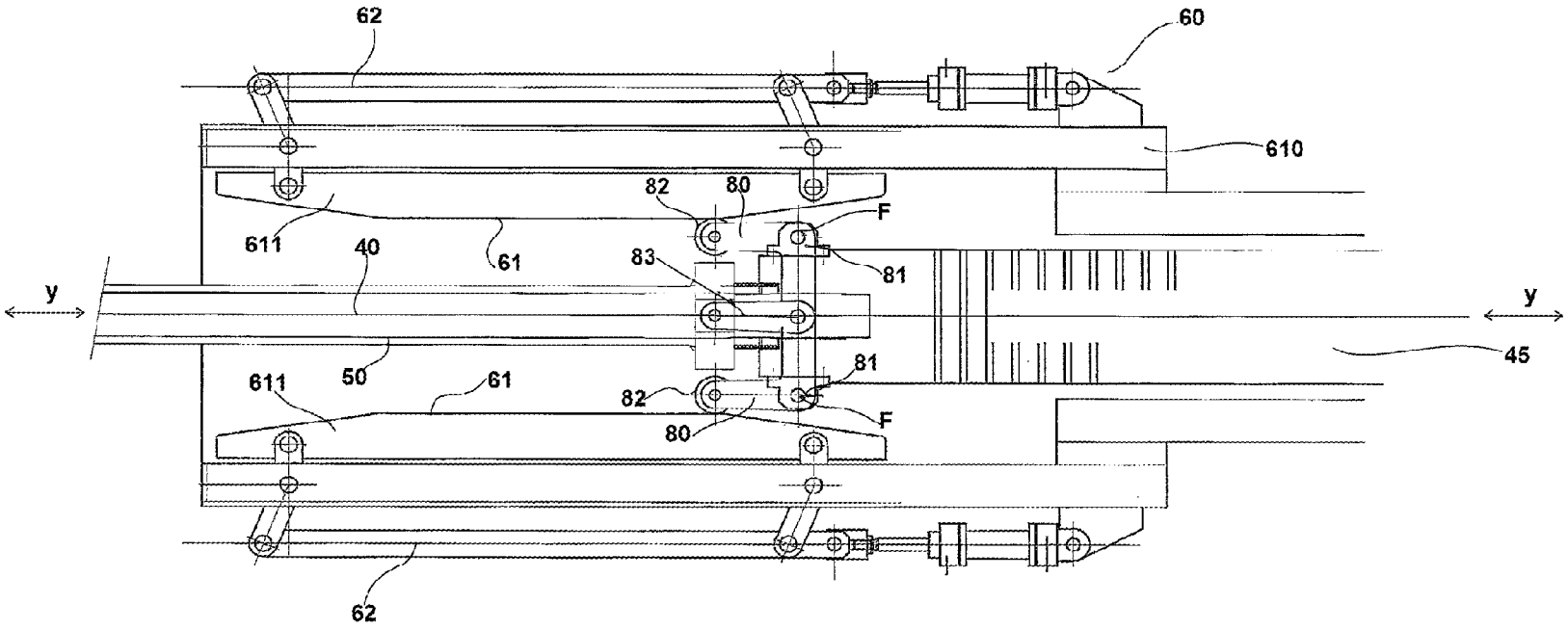
FIG. 7 shows a longitudinal section view of the rolling mill unit according to an embodiment of the present invention for switching the engagement head during a further step of switching.

Again, as shown, in the connection zone between the traction bar 40 and the toothed bar 45, in particular on the toothed bar 45, are hinged (each in a fulcrum F) rocker arms 80, each of which can rotate in the two opposite rotation directions indicated by the double arrows in FIG. 6. Furthermore, the end portion 81 of each rocker arm 80 is fixed to a corresponding transmission arm 83, in turn interposed between the jacket 50 and the respective rocker arm 80. It thus apparent that the rotation of the rocker arms 80 in a first rotation direction (such as to approach the end 82 opposite to the end 81 with respect to the fulcrum F to the jacket 50) results in a translation of the respective transmission arm 83 in a first translation direction, in particular from the left rightwards with respect to the figures, and thus in a translation of the jacket 50 away from the head 30, and thus ultimately in the switching of the head 30 from the closed configuration to the open configuration according to the methods described above. On the contrary, a rotation of the rocker arms 80 in the opposite rotation direction (such to move the end 82' of each rocker 80 away from the jacket 50) results in a translation motion of the respective transmission arms 83 and of the jacket 50 in the opposite translation direction, and then from the right leftwards with respect to the figures, and thus ultimately in the switching of the header 30 from the open configuration to the closed configuration, also in this case according to the methods described above.

Thus imagining, with contrast elements 611 in the closed position in FIG. 6, the traction bar 40 and the jacket 50 translating inside the main body 610 of the unit 60 (step in FIG. 1*c*, from the right leftwards in FIG. 6) it can be inferred that, the end portion 82 of each of the rocker arms 80 engaging the contrast surface 61 of the contrast element corresponding 611, the mutual engagement of the end portion 82 of each of the rocker arms 80 with the engagement surface or corresponding contrast 61 results in the rotation of the rocker arms 80 in the rotation direction in which the respective end portions are pushed toward the jacket 50, and thus into a retraction of the jacket 50 and finally into the switching of the header 30 from the closed configuration to the open configuration.

Figure 8:
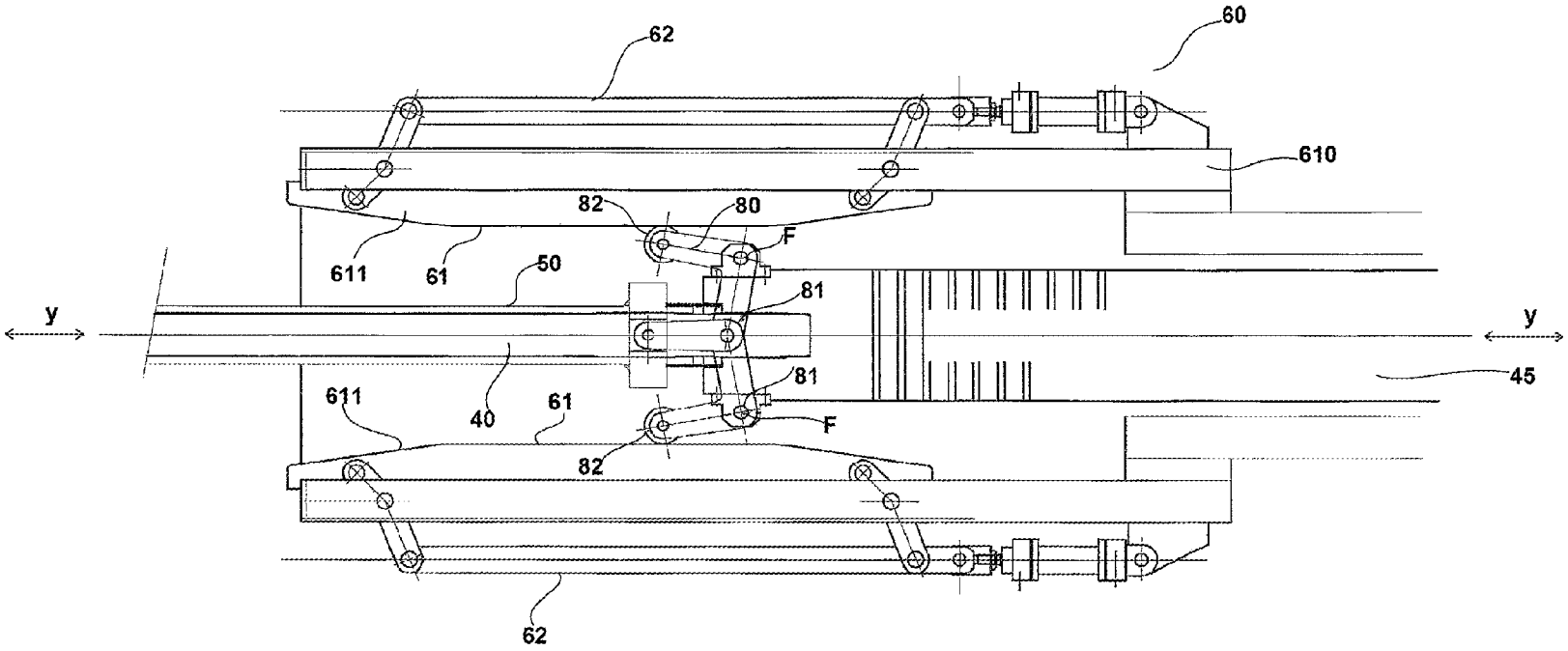
FIG. 8 shows a longitudinal section view of the rolling mill unit according to an embodiment of the present invention for switching the engagement head during a further step of switching.

The inverse switching of the header 30 from the open configuration to the closed configuration (step shown in FIG. 1*d*) is achieved by actuating the levers 62 and the respective backward movement of the engagement surfaces 61, ultimately in repositioning them from the closed position in FIG. 6 to the open position or retracted position in FIG. 8. At this point, by virtue of the elastic reaction of the elastic means 90 previously loaded by the rotation of the rocker arms 80 in the first rotation direction (according to which the respective end portions are approached to the jacket 50), the rocker arms 80, at this point released from the constraint applied by the contrast elements 61, are rotated in the opposite rotation direction according to which the end portions 82 are moved away again from the jacket 50, with the consequent translation from the right leftwards with respect to the figures and thus towards the header 30 of the jacket 50, and therefore ultimately with a consequent switching of the header 30 from the open configuration to the closed configuration (in this case into engagement on the shank 23 as shown in FIG. 1*d*).

Figure 9:
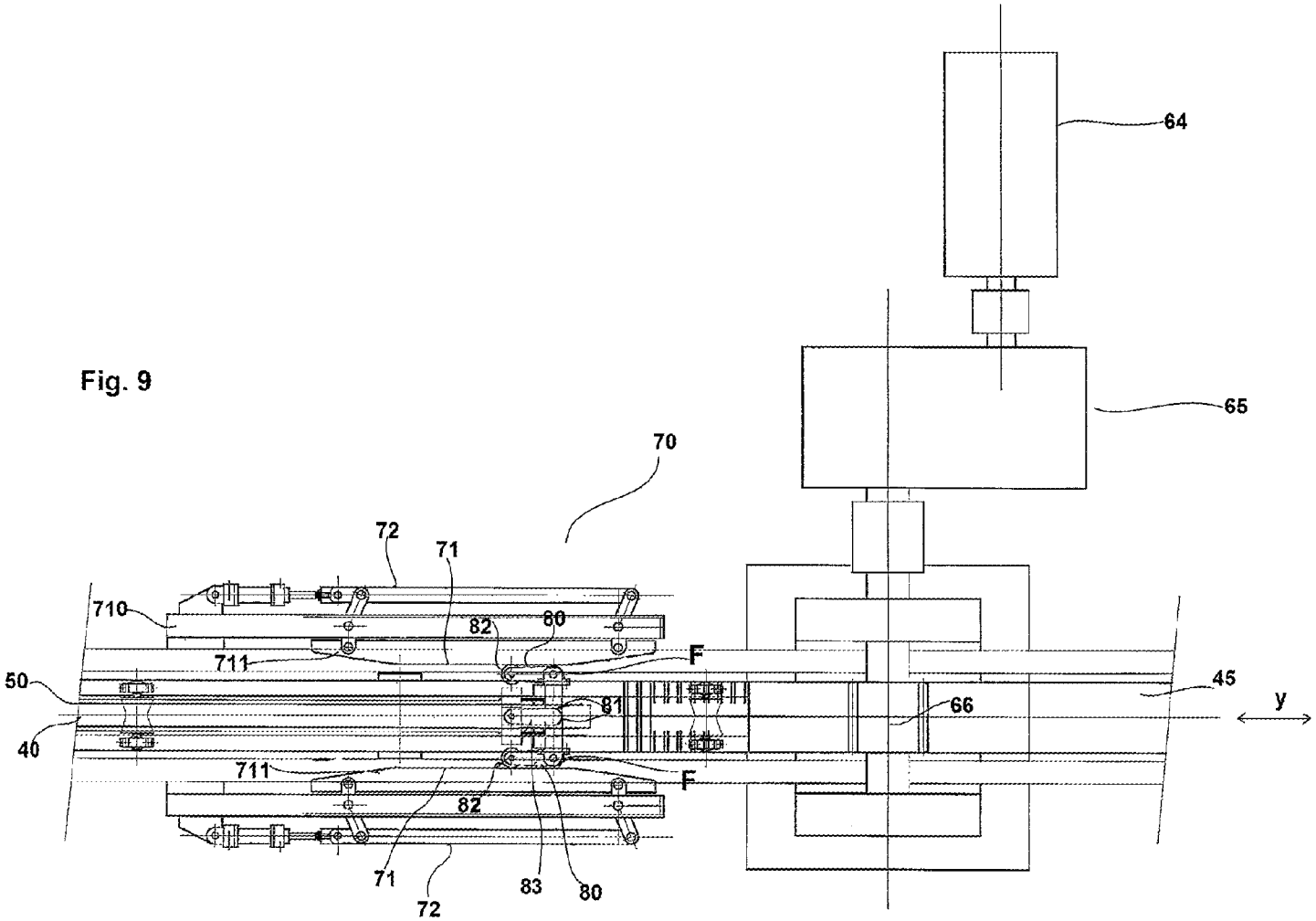
FIG. 9 shows a longitudinal section view of a further rolling mill unit according to an embodiment of the present invention for switching the engagement head during a step of switching.
Figure 10:
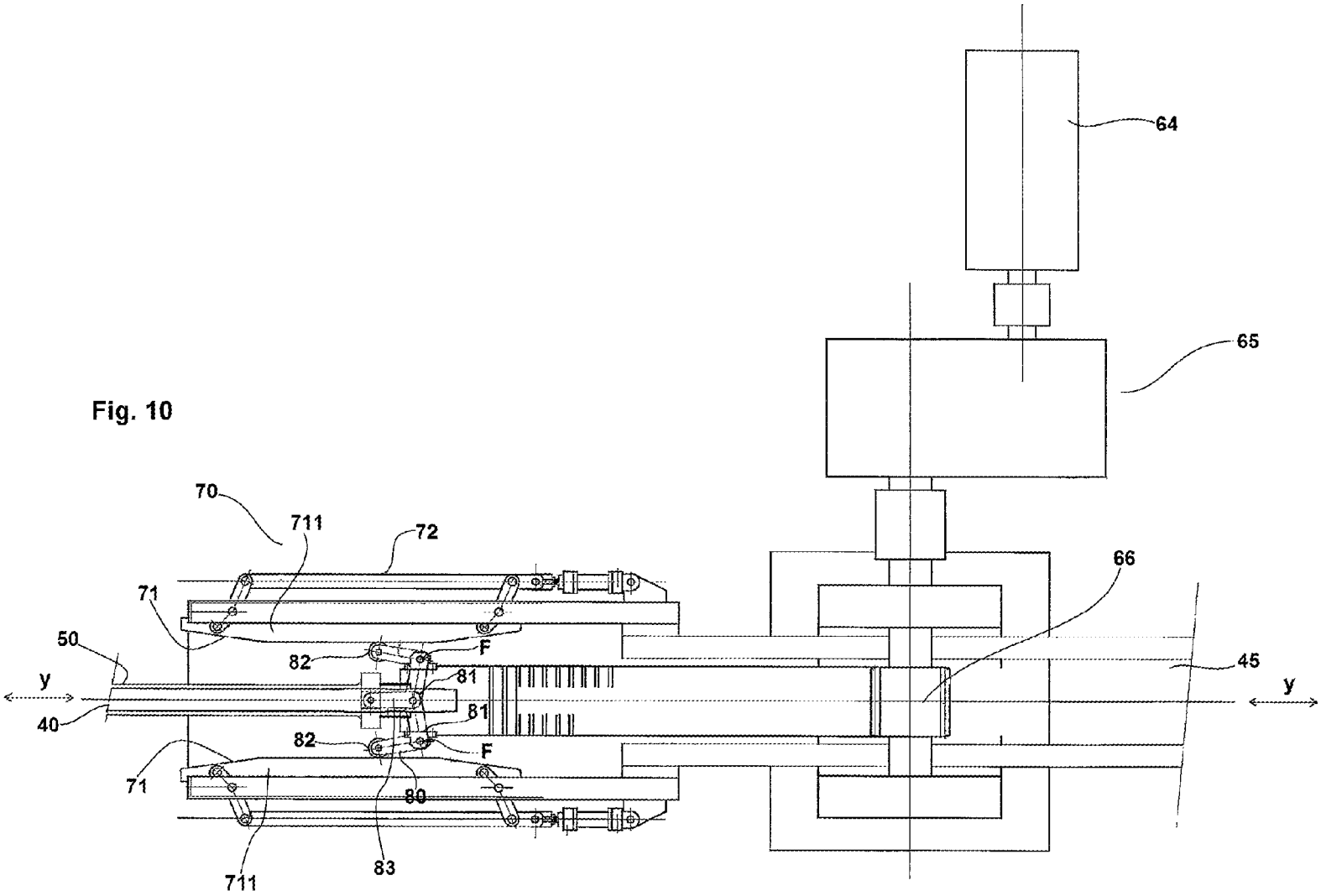
FIG. 10 shows a longitudinal section view of the rolling mill unit in FIG. 8 during a further step of the switching.

For the switching of the header 30 again from the closed configuration to the open configuration to release the shank 23 (working step shown in FIG. 1*g*), according to the embodiment of the present invention, a second switching unit 70 is provided, the latter positioned near the pinions 66, as shown in FIG. 1 and in FIGS. 9 and 10.

Station 70 is entirely similar to station 60 and so detailed description will be omitted for the sake of brevity. It is worth noting that in FIGS. 9 and 10, the component parts of the station 70 corresponding to the component parts of the station 60 shown in figures from 6 to 8 and identified therein with reference numbers such as, for example, 60, 62, 610 or the like, in FIGS. 9 and 10 are identified by reference numerals 70, 72, 710 etc. respectively.

It is further worth noting that the switching of the rocker arms 80, and thus of the jacket 50 and ultimately of the header 30, in this case is the result of the translation of the bar 40 away from the bench 10, so the rockers 80 in this case engage the corresponding surfaces 71 of the contrast elements 711 entering into the hollow main body 710 of the station 70 on the opposite side of the station itself.

We have thus demonstrated by means of the detailed description of the embodiments of the present invention shown in the drawings given above that the present invention allows to achieve the desired objects and to overcome or at least limit the drawbacks found in the prior art.

In particular, the rolling mill according to the present invention, as compared to roller mills according to the known art, allows a considerable simplification of the system, where the rolling mill according to the present invention does not require the installation of the guides and related sliding rails, and therefore of the corresponding anchorages for containing the mandrel and the push bar. Furthermore, foundations are not required under the mill for rack system (pinions 66 and toothed bar 45 and respective power source 64 and possibly the transmission 65) because the toothed bar 45 can slide on the surface. Moreover, the toothed bar 45 of rack works in line with the rolling bench 10 instead from underneath, as in the case of traditional push rolling mills, with obvious advantages in terms of cost reduction, mechanical and plant engineering simplification, as well as in terms of accessibility for maintenance operations.

The rolling mill according to the present invention also allows to obtain a considerable improvement of the machining tolerances of the tubular elements as the rolling mill is self-centering and therefore allows to eliminate the effect of twisting of the mandrel. With the rolling mill according to the present invention are also obtained improved efficiency because the rolling mill allows the reduction of downtime, where for example it is desired to vary the diameter of the produced tubes, the time required for changing the mandrel (from a mandrel of one diameter to a mandrel of a different diameter) is reduced by 24-48 h at 0.5 h.

Furthermore, with the rolling mill according to the present invention, maintenance and management costs are drastically reduced, as well as those for installation, with an economic return given also by the increased versatility of the rolling mill itself. Finally, very importantly, safety is considerably improved by virtually eliminating the risks of jamming of the push bar-mandrel mandrel during processing, with considerable and evident advantages in terms of safety of the operators, in particular those called to operate near the operating panel is usually located in the inlet zone of the rolling mill itself.

Although the present invention is explained above by means of a detailed description of the embodiments thereof shown in the drawings, the present invention is not obviously limited to the embodiments described above and shown in the drawings; on the contrary, all the variants and/or changes to the embodiments described and shown in the accompanying drawings will appear obvious and immediate to those skilled in the art. For example, according to the present invention and depending on the circumstances and/or needs, the operating head (30) may be replaced by other devices, such as a screw or, for example, a bayonet coupling, which allows to provide a connection between the actuating means and the mandrel (20).

Furthermore, within the scope of the present invention, it is also possible to provide the reverse arrangement of the shank (23) and the header (30) on the actuating means and on the mandrel (20), respectively.

The present invention also allows the widest choice of components.

The scope of protection of the present invention is thus defined by the claims.

The invention claimed is:

1. A rolling mill for rolling concave, rod-shaped bodies, said rolling mill comprising a rolling section with a plurality of mill stands and/or rolling dies arranged in succession to define a rolling axis Y, said rolling mill further comprising moving means for moving a mandrel and a hollow blank fitted on an end portion of said mandrel along said rolling axis Y and through said mill stands or rolling dies in succession, characterized in that said moving means are structured so as to move said mandrel and said blank along a rolling direction parallel to said rolling axis Y and through said mill stands or rolling dies in succession by applying a traction on said mandrel, characterized in that said moving means comprise an engaging operating head switchable between a first releasing configuration and a second engaging configuration and adapted to engage and alternatively release a shank integral with said end portion of said mandrel, wherein with said operating head in said second engaging configuration and engaged on said shank, the moving of said engaging operating head along a direction parallel to said rolling axis Y results in said mandrel and said blank being translated along said rolling axis Y and through said mill stands or rolling dies in succession, characterized in that said engaging operating head comprises at least one first rocker arm adapted to be switched to pivot between a first position and a second position, and in that switching of said at least one first rocker arm from said first position to said second position results in said operating head being switched from said first releasing configuration to said second engaging configuration, while switching of said at least one first rocker arm from said second position to said first position results in said operating head being switched from said second engaging configuration to said first releasing configuration, characterized in that the rolling mill comprises switching means for switching said at least one first rocker arm alternatively between said first and second positions, characterized in that said at least one first rocker arm is hinged on a point integral with a traction rod of said moving means, in that said traction rod is housed at least partially in a tubular jacket which is translatable with respect to said traction rod, and in that a translation of said tubular jacket with respect to said traction rod in a first translation direction results in said at least one first rocker arm being switched from said first position to said second position, while a translation of said tubular jacket with respect to said traction rod in a second translation direction opposite to the first translation direction results in said at least one first rocker arm being switched from said second position to said first position.

2. The rolling mill according to claim 1, characterized in that it comprises first translation means for translating said tubular jacket with respect to said traction rod in said first translation direction.

3. The rolling mill according to claim 2, characterized in that said first translation means comprise a first fixed switching station, which defines at least one first engagement surface, and at least one second rocker arm, hinged on a point integral with said traction rod, wherein a translation of said traction rod along a translation direction parallel to said rolling direction results in said at least one first engagement surface being switched by said at least one second rocker arm and said at least one second rocker arm being switched from a first position to a second position, and in that switching of said at least one second rocker arm from said first position to said second position results in said tubular jacket being translated with respect to said traction rod in said second translation direction opposite to said first translation direction and thus in said head being switched between said second engaging configuration and said first releasing configuration.

4. The rolling mill according to claim 3, characterized in that said first translation means comprise means for switching said at least one first engagement surface of said first fixed switching station in releasing position by said at least one second rocker arm, and in that said first translation means comprise elastic means for automatically translating said tubular jacket in said first translation direction, when said at least one first engagement surface of said first fixed switching station is released from said at least one second rocker arm.

5. The rolling mill according to claim 1, characterized in that it comprises translation means for translating said tubular jacket with respect to said traction rod in said second translation direction.

6. The rolling mill according to claim 5, characterized in that said translation means comprise a fixed switching station, which defines at least one engagement surface, and at least one second rocker arm, hinged on a point integral with said traction rod, wherein a translation of said traction rod along a translation direction parallel to said rolling direction results in engagement of said at least one engagement surface by said at least one second rocker arm and in said at least one second rocker arm being switched from a first position to a second position, and in that switching of said at least one second rocker arm from said first position to said second position results in the translation of said tubular jacket in said first translation sense direction opposite to said second translation direction and thus in said head being switched between said second engaging configuration and said first releasing configuration.

7. The rolling mill according to claim 6, characterized in that said translation means comprise means for switching said at least one engagement surface of said fixed switching station in releasing position by said at least one second rocker arm, and in that with said at least one engagement surface of said fixed switching station released from said at least one second rocker arm, action of elastic means results in automatic translation of said tubular jacket in said first translation direction.

* * * * *